US008714789B2

(12) United States Patent
Moore

(10) Patent No.: US 8,714,789 B2
(45) Date of Patent: May 6, 2014

(54) RETRACTABLE LIGHTING SYSTEM

(76) Inventor: Michael Moore, Ames, IA (US)

( * ) Notice: Subject to any disclaimer, the term of this patent is extended or adjusted under 35 U.S.C. 154(b) by 0 days.

(21) Appl. No.: 13/542,731

(22) Filed: Jul. 6, 2012

(65) Prior Publication Data

US 2014/0009940 A1 Jan. 9, 2014

(51) Int. Cl.
*F21S 8/00* (2006.01)

(52) U.S. Cl.
USPC ..... 362/427; 362/227; 362/249.01

(58) Field of Classification Search
USPC ..... 362/427, 227, 249.01, 249.09, 249.1, 362/269–274, 285, 371, 431
See application file for complete search history.

(56) References Cited

U.S. PATENT DOCUMENTS

| | | | | | |
|---|---|---|---|---|---|
| 1,370,697 | A * | 3/1921 | Mann | 40/608 |
| 3,034,098 | A * | 5/1962 | Clasen | 340/908 |
| 3,310,673 | A * | 3/1967 | Fletcher | 362/270 |
| 3,369,117 | A * | 2/1968 | Nicolosi | 362/270 |
| 3,995,250 | A * | 11/1976 | Ferree | 340/908 |
| 6,118,388 | A * | 9/2000 | Morrison | 340/908 |
| 6,150,957 | A * | 11/2000 | Henz et al. | 340/908 |
| 6,299,336 | B1 * | 10/2001 | Hulse | 362/526 |
| 6,547,429 | B2 * | 4/2003 | Vanduyn et al. | 362/530 |
| 7,631,995 | B1 * | 12/2009 | Pedersen | 362/427 |
| 7,857,481 | B2 * | 12/2010 | Oh et al. | 362/202 |
| 2003/0196360 | A1 * | 10/2003 | Colip | 40/610 |
| 2008/0129543 | A1 * | 6/2008 | Lee | 340/908 |
| 2009/0322563 | A1 * | 12/2009 | Stadtmiller et al. | 340/909 |

* cited by examiner

*Primary Examiner* — Mary Ellen Bowman
(74) *Attorney, Agent, or Firm* — Zarley Law Firm, PLC

(57) ABSTRACT

A retractable lighting system having a housing, a bracket, an extendable support member, a locking device, a control box, a lighting assembly and spreader bars.

10 Claims, 3 Drawing Sheets

RETRACTABLE LIGHTING SYSTEM

BACKGROUND OF THE INVENTION

This invention is directed toward a retractable lighting system and more particularly a retractable lighting system for use in traffic situations.

Presently, lighting systems are used to direct traffic when there is construction, to control traffic flow, and when there is an accident. Typically, these lighting systems are large and expensive and are either mounted on a vehicle or pulled behind on a trailer. Desired is a lighting system that is more compact, less expensive, and easier to transport and store.

Therefore, an objective of the present invention is to provide a lighting system that is compact and can be folded away.

Another objective of the present invention if to provide a lighting system that is less expensive to manufacture.

A still further objective is to provide a lighting system that is easy to transport and store.

These and other objectives will be apparent to those of skill in the art based upon the following written description, drawings and claims.

BRIEF SUMMARY OF THE INVENTION

A retractable lighting system having a housing with a bracket mounted to the housing, an extendable support member pivotally connected to the bracket, a locking device mounted to the support member that engages the bracket, a control box mounted to the support member, and a plurality of light fixtures capable of being spread as the support member is extended.

DETAILED DESCRIPTION OF THE PREFERRED EMBODIMENT

Figure 1:
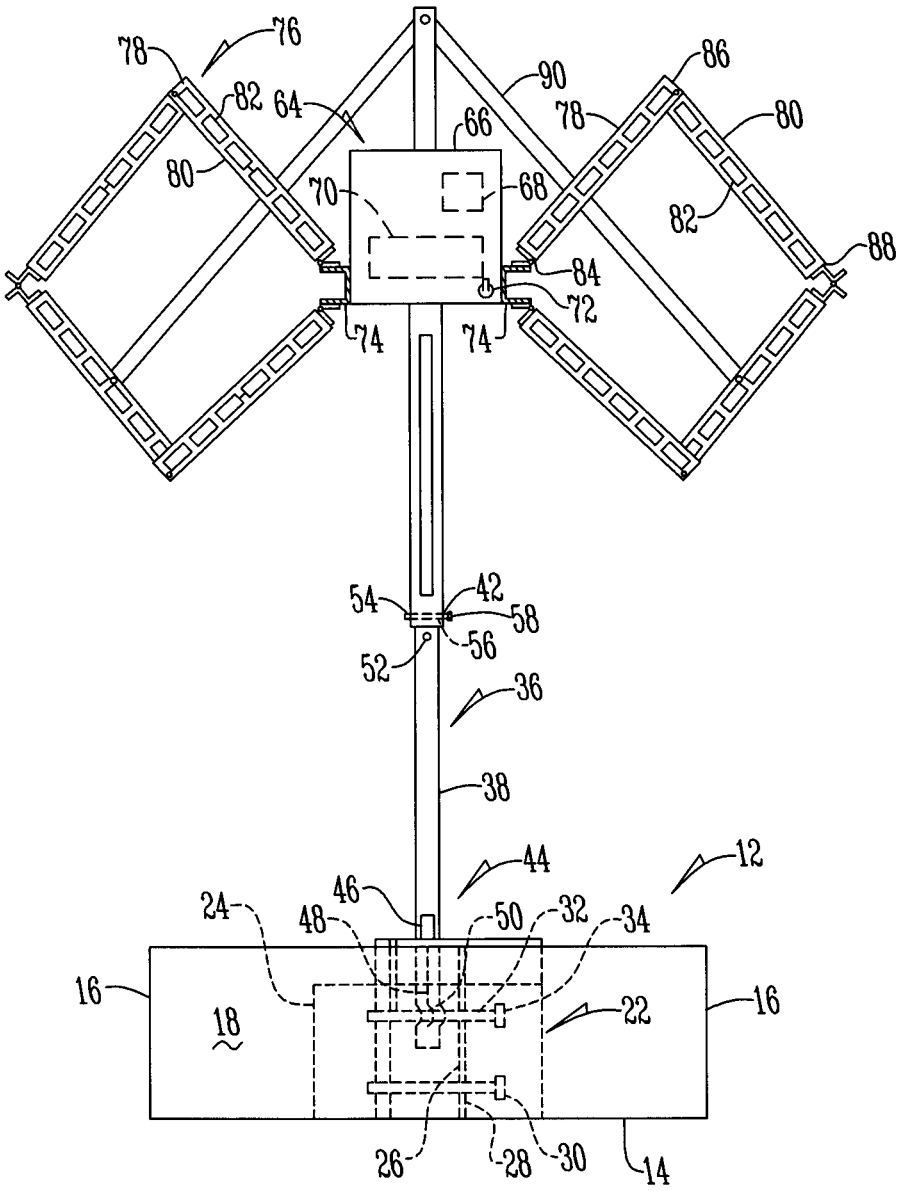
FIG. 1 is a front view of a lighting system.
Figure 2:
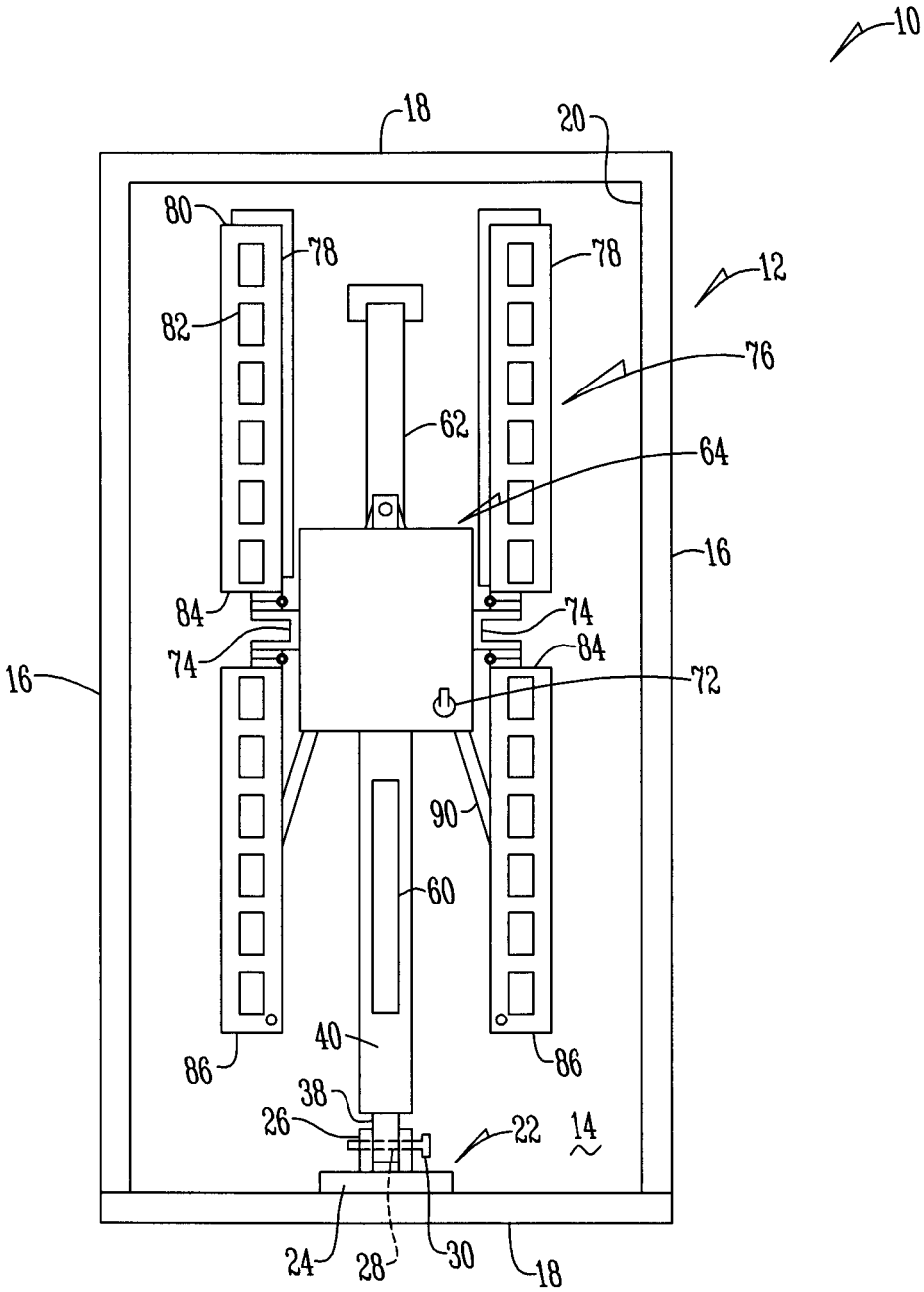
FIG. 2 is a top plan view of a lighting system.
Figure 3:
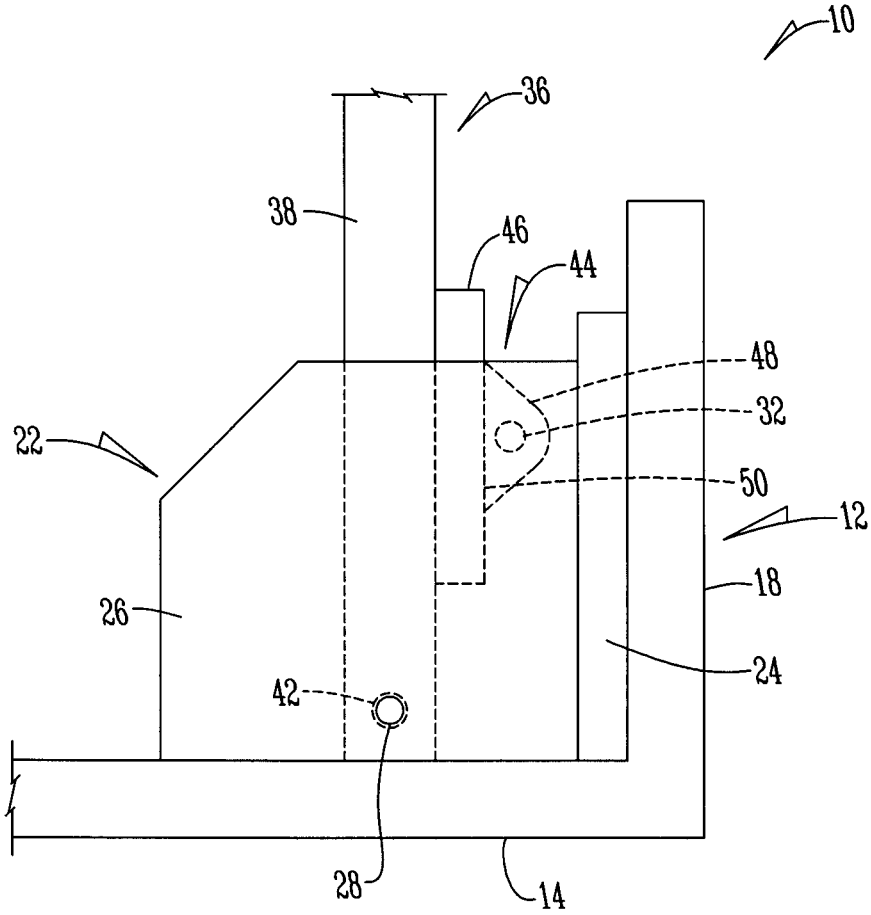
FIG. 3 is a partial sectional view of a bracket and locking device of a lighting system.

Referring to the Figures, the retractable light system 10 has a housing 12 that includes a bottom 14, sidewalls 16, end walls 18 and a removable top 20. Connected to one end wall 18 is a bracket 22. The bracket 22 is of any size, shape, and structure and preferably has a plate 24 mounted to the end wall 18 with a pair of support flanges 26 that extend outwardly from the plate 24 in spaced parallel relation. Adjacent the bottom of each flange 26 are bottom openings 28 that are aligned with one another for receiving a pivot pin 30. On at least one flange is an upper opening 32 that receives a spring loaded lock pin 34.

Pivotally connected to the bracket 22 is a retractable support member 36. Preferably, the retractable support member 36 includes a first hollow member 38 that is telescopically received within a second hollow member 40. The first hollow member 38 fits between flanges 26 and has a pair of openings 42 that align with bottom openings 28 such that the first hollow member 38 is pivotally connected to bracket 22 by the pivot pin 30 extending through openings 28 and 42.

Mounted to the first member 38, adjacent openings is a locking device 44. The locking device 44 is of any size, shape, and structure and preferably is an outwardly extending flange 46 with a curved guide portion 48 having an opening 50. The locking device 44 is positioned on the first member 38 and formed such that as the first member 38 is raised toward end wall 18 the guide portion 48 of flange 46 engages the end of the spring load lock pin 334 to push the pin 34 into a retracted position until opening 50 aligns with pin 334 when first member 38 is in an upright position such that pin 34 extends into opening 50 locking the first member 38 in an upright position.

Upstream from the locking device 44 on first member 38 is a knob or detent 52 that is positioned to align or register with openings 54 in the second hollow member 40. Alternative to the knob 52 are openings 56 on the first hollow member 38 that are positioned to align with openings 54 and receive a locking pin 58 to hold support member 36 in an extended position.

To assist in raising support member 36 to an upright position, a handle 60 is connected to the second hollow member 40. Alternatively, to raise the support member 36 actuating device 62, such as an electrical solenoid or the like, is connected to the housing 12 at one end and the second hollow member 40 at the opposite end. Preferably, the actuator is remotely activated.

Mounted adjacent the top of the second hollow member 40 is a control box 64. The control box 64 includes a housing 66 with a battery 68 and circuit board 70 disposed within the housing 66. A switch 72 is mounted to the exterior of the housing 66 and is electrically connected to the circuit board 70.

Connected to the control box 64 via a light bracket 74 is a light assembly 76. The light assembly includes a plurality of light fixtures 78 with each light fixture 78 having a partial housing 80 and a plurality of lights 82, preferably LEDs, mounted to the housing 80 and electrically connected to the circuit board 70 of control box 64.

Preferably, the light assembly 76 includes eight light fixtures 76 wherein four of the light fixtures 76 are pivotally connected to the light bracket 74 at one end 84 and pivotally connected to the remaining four light fixtures at the opposite end 86. Of the four remaining light fixtures 76, the adjacent remaining ends 88 are pivotally connected such that, when extended, the light assembly 74 generally forms two diamonds. To assist in extending the light assembly 74, a pair of spreader bars 90 is pivotally connected to the second hollow member 40 at one end and to separate light fixtures 76 on opposite sides of the support member 36 at the opposite end.

In operation, during storage or transportation, the retractable light assembly 10 is contained within housing 12. To use, top 20 is removed and support member 36 is raised to an upright position. Support member 36 is raised by grasping handle 60 and manually lifting or by activating actuator 62. As support member 36 is raised, the curved guide portion 48 of the locking device 44 engages the end of spring loaded locking pin 34 pushing pin 34 into a retracted position until the pin aligns with opening 50. Once the pin 34 aligns with opening 50, the pin extends into opening 50 locking support member 36 in an upright position.

Once locked, the second hollow member 40 is raised in relation to the first hollow member 38 to a desired height where knob 52 is received in opening 54 to hold the second hollow member 40 in a raised position. Alternatively, opening 54 is aligned with opening 56 and a locking pin 58 is inserted into both openings 54 and 56 to hold the second hollow member 40 in a raised position.

As the second hollow member 40 is raised, based on the force created by the spacer bars 90, the light fixtures 76 pivot away from the control box 64 and one another to form a pair of generally shaped diamonds. Once positioned, switch 72 is activated causing the lights 82 to flash based upon the programming of the circuit board.

Accordingly, a retractable light system has been shown that, at the very least, meets the stated objectives of this invention.

What is claimed is:

1. A retractable light system comprising:

a housing;

a retractable support member pivotally connected to the housing;

a locking device mounted to the housing and positioned to selectively retain the support member in a generally upright position;

a control box mounted to the support member; and a light assembly pivotally connected to the control box;

wherein when the system is in transportation or storage the light assembly is contained within the housing.

2. The system of claim 1 wherein the support member has a first hollow member slidably received within a second hollow member.

3. The system of claim 1 wherein the locking device includes a curved guide portion with an opening positioned to receive a locking pin.

4. The system of claim 1 wherein the light assembly includes a plurality of light fixtures with each light fixture having a partial housing and a plurality of lights.

5. The system of claim 1 further comprising a pair of spreader bars connected to the support member at one end and the light assembly at the opposite end.

6. The system of claim 1 further comprising an actuator connected to the housing at one end and the support member at the opposite end.

7. The system of claim 1 wherein when the system is in an upright position, the light assembly is positioned exterior to the housing.

8. The system of claim 2 further comprising a handle connected to the second hollow member.

9. The system of claim 4 wherein when the system is in an upright position, the light assembly generally forms two diamonds.

10. The system of claim 6 wherein the actuator is remotely activated.

* * * * *